US007264339B2

(12) United States Patent
Takahashi

(10) Patent No.: US 7,264,339 B2
(45) Date of Patent: Sep. 4, 2007

(54) DROPLET EJECTING APPARATUS

(75) Inventor: Yoshikazu Takahashi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 2 days.

(21) Appl. No.: 10/692,139

(22) Filed: Oct. 22, 2003

(65) Prior Publication Data

US 2004/0119792 A1 Jun. 24, 2004

(30) Foreign Application Priority Data

Oct. 29, 2002 (JP) ..... 2002-314539

(51) Int. Cl.
*B41J 2/45* (2006.01)

(52) U.S. Cl. ..... 347/71

(58) Field of Classification Search ..... 347/68–72
See application file for complete search history.

(56) References Cited

U.S. PATENT DOCUMENTS

| | | | | |
|---|---|---|---|---|
| 5,144,342 | A * | 9/1992 | Kubota | 347/70 |
| 5,266,964 | A | 11/1993 | Takahashi et al. | |
| 5,402,159 | A * | 3/1995 | Takahashi et al. | 347/9 |
| 6,682,180 | B2 * | 1/2004 | Sakamoto et al. | 347/70 |
| 6,719,409 | B2 * | 4/2004 | Sasaki et al. | 347/70 |

FOREIGN PATENT DOCUMENTS

| | | | |
|---|---|---|---|
| JP | 63179753 | | 7/1988 |
| JP | 64-18460 | * | 1/1989 |
| JP | 6000956 | | 1/1994 |
| JP | 10138471 | | 5/1998 |
| JP | 11-150754 | | 6/1999 |
| JP | 3128857 | B2 | 1/2001 |
| JP | 2001-353874 | | 12/2001 |

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

An ink jet printer head includes a channel unit and an actuator unit that are bonded to each other. The channel unit has pressure chambers located between a manifold and nozzles. The actuator unit includes piezoelectric sheets, and individual electrodes and common electrodes that are sandwiched by the piezoelectric sheets. Two individual electrodes are paired, and are provided in an area corresponding to each one of the pressure chambers, and cooperate with the common electrodes and the piezoelectric sheets to provide two active portions. When the actuator unit is driven or operated, the two active portions, and respective portions of the piezoelectric sheets that are located between the two active portions are elongated in the direction of thickness of the actuator unit, so that the volume of the each pressure chamber as a whole is decreased. Consequently a droplet of ink is ejected from the nozzle corresponding to the each pressure chamber.

13 Claims, 10 Drawing Sheets

DROPLET EJECTING APPARATUS

BACKGROUND OF THE INVENTION

1. Field of the Invention

The present invention relates to a droplet ejecting apparatus that changes a volume of a pressure chamber and thereby ejects a droplet from a nozzle.

2. Discussion of Related Art

There is known a droplet ejecting device having a channel unit including a liquid supply manifold that supplies a liquid; a nozzle; and a pressure chamber provided between the liquid supply manifold and the nozzle. The droplet ejecting device changes a volume of the pressure chamber and thereby ejects a droplet of the liquid accommodated in the pressure chamber, from the nozzle. The droplet ejecting device is employed by, e.g., an ink jet printer head, as disclosed by Japanese Patent No. 3,128,857 (FIG. 1) or its corresponding U.S. Pat. No. 5,402,159.

Here, the construction and operation of the droplet ejecting device employed by the above-indicated printer head is described by reference to FIGS. 9 and 10 of the present application. FIGS. 9 and 10 show a droplet ejecting device 101 that is substantially identical with the droplet ejecting device disclosed by the above-indicated patent. More specifically described, FIG. 9 shows a condition of the droplet ejecting device 101 when a piezoelectric actuator unit 200 is not being operated; and FIG. 10 shows a condition of the droplet ejecting device 101 when the actuator unit 200 is being operated.

As shown in FIG. 9, the droplet ejecting device 101 includes a channel unit 100 having manifolds 111*a*, 112*a* communicating with an ink supply source, not shown, and functioning as an ink channel; a nozzle 154 through which droplets of the ink are ejected; and a pressure chamber 116 provided between the manifolds 111*a*, 112*a* and the nozzle 154. The actuator unit 200 that is deformable to change a volume of the pressure chamber 116, is adhered to an upper surface of the channel unit 100.

The channel unit 100 is provided by sheet members 143, 111, 112, 113, 114 that are stacked on each other. The sheet members 111, 112 have respective openings defining the respective manifolds 111*a*, 112*a*; and the sheet member 114 has an opening defining the pressure chamber 116. The actuator unit 200 is provided by individual electrodes 124 and common electrodes 125 that are alternately stacked on each other, and piezoelectric sheets 121*a*, 121*b*, 121*c*, 121*d*, 121*e*, 121*f* that are stacked alternately with the individual and common electrodes 124, 125.

The individual electrodes 124 are connected to an external positive electrode 130 via a through-hole 132; and the common electrodes 125 are connected to an external ground electrode 131 via a through-hole 133. Respective portions of the piezoelectric sheets 121*b*-121*e* that are sandwiched by the individual and common electrodes 124, 125 cooperate with each other to provide an active portion 161 that is opposed to the pressure chamber 116 of the channel unit 100 and is polarized, in advance, in a direction of thickness of the actuator unit 200.

When an electric field is produced by the individual and common electrodes 124, 125 in the same direction as the direction of polarization of the active portion 161, the active portion 161 is deformed, as shown in FIG. 10, in the direction of thickness of the actuator unit 200. As a result, the volume of the pressure chamber 116 is changed and a droplet 50 of ink is ejected from a nozzle 154.

In the droplet ejecting device 101, the individual electrodes 124 of the actuator unit 200 have substantially the same shape and size, in their plan view, as those of the pressure chamber 116, and the common electrodes 125 have such a size that the common electrodes 125 can each be opposed to a plurality of pressure chambers 116 of the channel unit 100. Therefore, respective "opposed" portions, Lx, of the individual and common electrodes 124, 125 that are opposed to each other in the direction of thickness of the actuator unit 200 have substantially the same shape in their plan view as that, Lc, of each pressure chamber 116. A total number of those opposed portions of the electrodes 124, 125 is equal to that of the pressure chambers 116. Meanwhile, a total area of those opposed portions of the electrodes 124, 125 is proportional to an electrostatic capacitance of the actuator unit 200; and the electrostatic capacitance is proportional to an amount of electric power consumption of a driver circuit that drives the actuator unit 200. If the electric power consumption of the driver circuit is high, the driver circuit needs to have a large size and accordingly it costs high. In addition, as the electric power consumption of the driver circuit increases, an amount of heat generated by it increases and accordingly it is needed to employ a heat sink having a large size. Thus, the overall size of the droplet ejecting device 101 is inevitably increased. Moreover, if the heat generated by the driver circuit is transmitted to the actuator unit 200, the operation of each active portion 161 is adversely influenced so that the each active portion 161 may not eject ink in a desired manner.

SUMMARY OF THE INVENTION

It is therefore an object of the present invention to provide a droplet ejecting apparatus that can employ an actuator unit having a small electrostatic capacitance and can enable a driver circuit to generate a reduced amount of heat. This object may be achieved according to any one of the following modes of the present invention in the form of a droplet ejecting apparatus, each of which is numbered like the appended claims and may depend from the other mode or modes, where appropriate, to indicate and clarify possible combinations of technical features. It is, however, to be understood that the present invention is not limited to the technical features or any combinations thereof that will be described below for illustrative purposes only. It is to be further understood that a plurality of features included in any one of the following modes of the invention are not necessarily provided altogether, and that the invention may be embodied without employing at least one of the features described in connection with each of the modes.

(1) A droplet ejecting apparatus, comprising a channel unit having at least one pressure chamber which communicates, at a first end thereof, with a liquid supply manifold so as to be supplied with a liquid by the liquid supply manifold and, at a second end thereof, with a nozzle so as to eject a droplet of the liquid through the nozzle; and an actuator unit fixed to the channel unit, the actuator unit having a plurality of active portions which are opposed to the at least one pressure chamber of the channel unit and each of which includes at least one first electrode and at least one second electrode, and a piezoelectric sheet interposed between the first and second electrodes, the plurality of active portions being deformed to change a volume of the at least one pressure chamber.

The sum of respective electrostatic capacitances of the plurality of active portions opposed to the pressure chamber is smaller than that of a single active portion that has substantially the same size as that of the pressure chamber and is opposed to the pressure chamber. Therefore, the amount of heat generated by a driver circuit that drives or operates the actuator unit can be reduced. Thus, the driver circuit can enjoy a small size and a low cost. In addition, a heat radiating device that may be employed to radiate the heat generated by the driver circuit can also enjoy a small size.

(2) The apparatus according to the mode (1), wherein the respective piezoelectric sheets of the plurality of active portions comprise respective portions of a common piezoelectric sheet, and are polarized in a direction of thickness of the common piezoelectric sheet, and wherein when an electric field is applied to the piezoelectric sheet of each of the plurality of active portions in a same direction as the direction of polarization thereof, the each active portion is elongated in the direction of thickness of the common piezoelectric sheet.

(3) The apparatus according to the mode (2), wherein the plurality of active portions comprise two active portions, and wherein a distance between the two active portions is selected at a value which assures that, when the two active portions are elongated in the direction of thickness of the common piezoelectric sheet, a portion of the common piezoelectric sheet that is located between the two active portions is elongated in a same direction as the direction of elongation of the two active portions.

According to this mode, the actuator unit can change the volume of the pressure chamber by substantially the same amount as the amount by which the volume of the pressure chamber is changed by a single active portion hat has substantially the same size as that of the pressure chamber and is opposed to the pressure chamber.

(4) The apparatus according to the mode (3), wherein the portion of the common piezoelectric sheet that is located between the two active portions is elongated in the same direction as the direction of elongation of the two active portions, by not less than 90% of an amount of elongation of each of the two active portions.

(5) The apparatus according to any of the modes (1) through (4), wherein an outer end portion of an outermost one of the plurality of active portions opposed to the pressure chamber is located at a position corresponding to a vicinity of an end portion of the pressure chamber.

According to this mode, the volume of the pressure chamber as a whole corresponding to the active portions can be changed. Thus, a pressure can be effectively applied to the liquid accommodated in the pressure chamber, and a droplet of the liquid can be smoothly ejected from the nozzle.

(6) The apparatus according to the mode (5), wherein the pressure chamber comprise an elongate pressure chamber, and the plurality of active portions comprise two active portions that are distant from each other by a predetermined distance in a lengthwise direction of the elongate pressure chamber, and wherein an outer end portion of at least one of the two active portions is located at a position inwardly distant from at least one of lengthwise opposite ends of the elongate pressure chamber by not more than 50% of the predetermined distance.

(7) The apparatus according to any of the modes (1) through (6), wherein a ratio of a sum of respective areas of the plurality of active portions to an area equal to a product of a length of the pressure chamber and a width of each of the active portions as measured in a direction perpendicular to a lengthwise direction of the pressure chamber is not smaller than 0.7 and smaller than 1.

According to this mode, an electric voltage that is applied to the actuator unit so as to assure a constant speed of ejection of droplet from the nozzle can be lowered. Therefore, a driver circuit that drives the actuator unit can enjoy a small size and a low cost. For example, the driver circuit may be provided by a low-voltage driver circuit. In addition, since the drive voltage is low, the heat generated by the driver circuit can be reduced and accordingly a heat radiating device that may be employed to radiate the heat can enjoy a small size. Preferably, the above-indicated ratio is not greater than 0.9.

(8) The apparatus according to any of the modes (1) through (6), wherein the pressure chamber comprises an elongate pressure chamber, and the plurality of active portions comprise two elongate active portions which are distant from each other in a lengthwise direction of the elongate pressure chamber and each of which extends parallel to the elongate pressure chamber, and wherein the elongate pressure chamber has a first width, and each of the elongate active portions has a second width smaller than the first width.

(9) The apparatus according to mode (8), wherein a ratio of a sum of respective areas of the plurality of elongate active portions to an area equal to a product of the second width of the each elongate active portion and a length of the elongate pressure chamber is not smaller than 0.7 and smaller than 1. Preferably, this ratio is not greater than 0.9.

(10) The apparatus according to the mode (8), wherein a ratio of a sum of respective lengths of the elongate active portions to a length of the elongate pressure chamber is not smaller than 0.7 and smaller than 1. Preferably, this ratio is not greater than 0.9.

(11) The apparatus according to any of the modes (1) through (10), wherein the channel unit has a plurality of pressure chambers which communicate, at respective first ends thereof, with a common liquid supply manifold so as to be supplied with a liquid by the common liquid supply manifold and, at respective second ends thereof, with respective nozzles so as to eject respective droplets of the liquid through the respective nozzles.

(12) The apparatus according to the mode (11), wherein the common liquid supply manifold comprises an ink supply manifold which supplies an ink as the liquid, and wherein the actuator unit changes a volume of each of the pressure chambers of the channel unit, so as to eject, from a corresponding one of the nozzles, a droplet of ink as the droplet of liquid and thereby form an image on a recording medium.

(13) A droplet ejecting apparatus, comprising a channel unit having at least one elongate pressure chamber which communicates, at a first end thereof, with a liquid supply manifold so as to be supplied with a liquid by the liquid supply manifold and, at a second end thereof, with a nozzle so as to eject a droplet of the liquid through the nozzle; and an actuator unit fixed to the channel unit, the actuator unit having a plurality of elongate active portions which are opposed to the at least one elongate pressure chamber of the channel unit and each of which includes at least one first electrode and at least one second electrode, and a piezoelectric sheet interposed between the first and second electrodes, the plurality of elongate active portions being deformed to change a volume of the at least one elongate pressure chamber, wherein a ratio of a sum of respective lengths of the elongate active portions to a length of the elongate pressure chamber is not smaller than 0.7 and smaller than 1.

This mode (13) may be combined with any of the above-described modes (1) through (9), (11), and (12). Preferably, the above-indicated ratio is not greater than 0.9.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings. A droplet ejecting apparatus according to the present invention includes an actuator unit and a channel unit that are bonded to each other, as will be described in detail later. In the present embodiment, the droplet ejecting apparatus is employed by a head of an ink jet printer.

Figure 1:
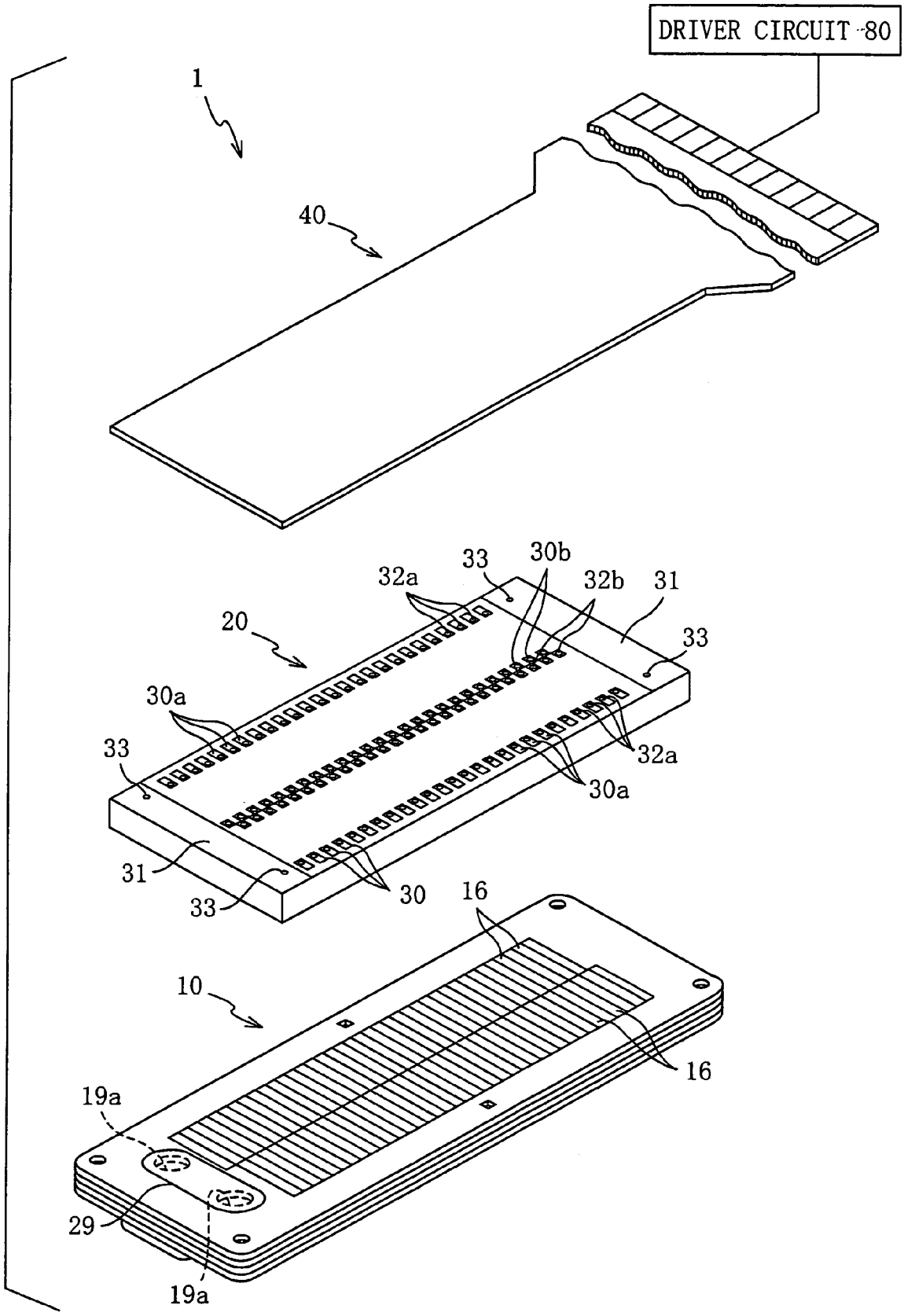
FIG. 1 is a perspective exploded view of a droplet ejecting apparatus to which the present invention is applied.

FIG. 1 shows an ink jet printer head 1 including a droplet ejecting apparatus as an embodiment of the present invention. The printer head 1 includes a channel unit 10 having a substantially rectangular parallelepiped shape, and an actuator unit 20 having substantially the same shape as that of the channel unit 10 and stacked on the same 10. The actuator unit 20 is equipped with a flexible flat cable 40 that connects the actuator unit 20 to external devices. The printer head 1 ejects droplets of ink downward from nozzles 54 opening in a lower surface of the channel unit 10.

Figure 2:
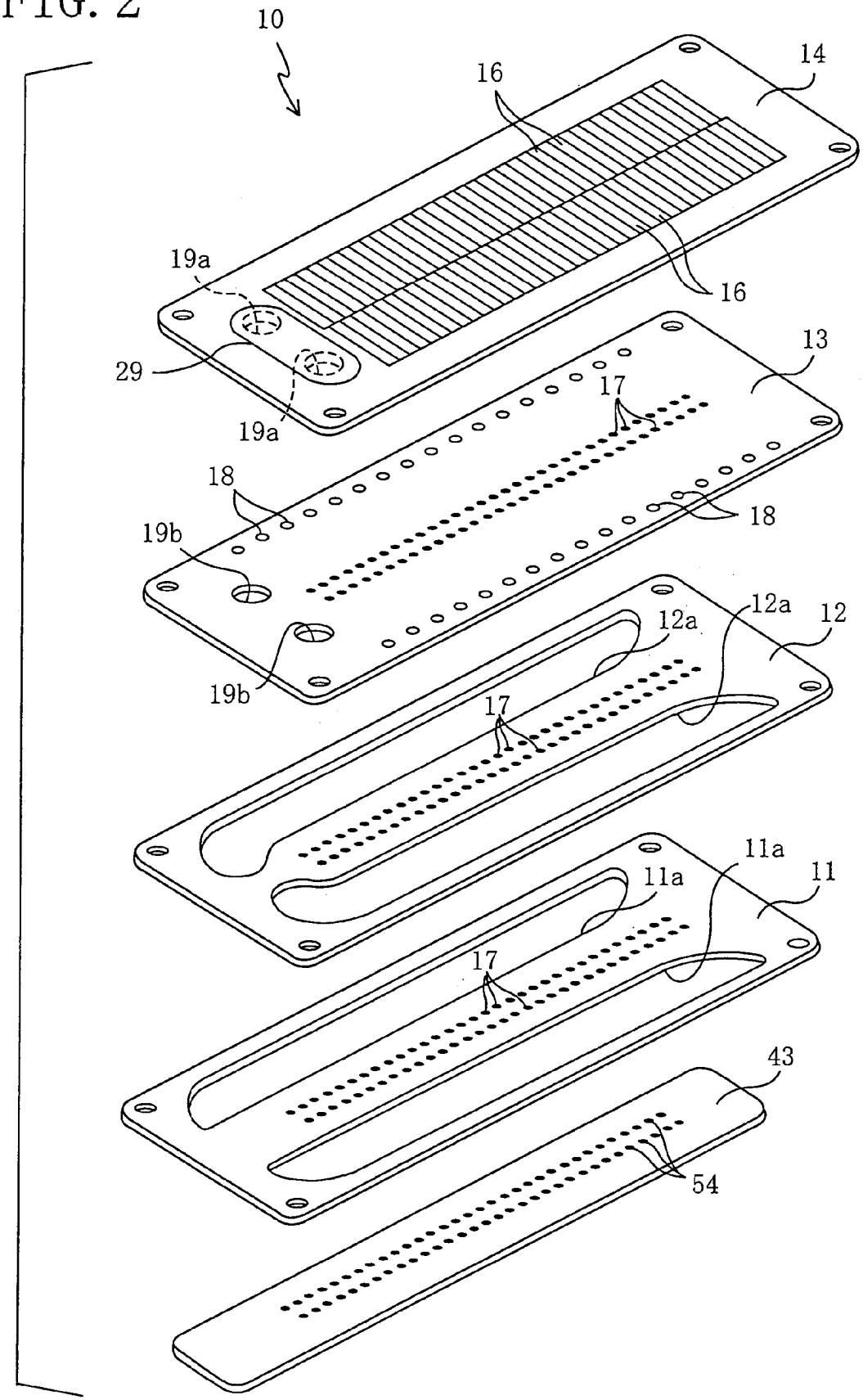
FIG. 2 is a perspective exploded view of a channel unit as part of the droplet ejecting apparatus.

As shown in FIG. 2, the channel unit 10 includes five thin sheets that are stacked on, and adhered to, each other. The five thin sheets are as follows: a nozzle sheet 43, two manifold sheets 11, 12, a spacer sheet 13, and a cavity sheet 14. In the present embodiment, the four sheets 11, 12, 13, 14 except for the nozzle sheet 43 are each formed of a 42% nickel alloy steel sheet and have respective thickness values each of from 50 μm to 150 μm. The nozzle sheet 43 has two arrays of nozzles 54 each having a small diameter, such that the two arrays of nozzles 54 are arranged in a first direction (i.e., a lengthwise direction) of the nozzle sheet 43, in a staggered or zigzag fashion. More specifically described, a number of nozzles 54 are formed through the thickness of the nozzle plate 43, in two arrays along respective reference lines parallel to the lengthwise direction of the nozzle plate 43, at a small regular interval, in a zigzag manner.

The manifold sheet 12 has two manifold openings 12*a*, 12*a*, each as part of an ink channel, that are formed through the thickness of the manifold sheet 12, such that the two manifold openings 12*a* extend along, and outside, the two reference lines along which the two arrays of nozzles 54 are arranged. Each of the manifold openings 12*a* is aligned, in its plan view, with an array of pressure chambers 16 formed in the cavity sheet 14, such that the each manifold opening 12*a* extends over the array of pressure chambers 16 in the lengthwise direction of the nozzle plate 43. The manifold sheet 11 provided beneath the manifold sheet 12 has, in its upper surface, two manifold recesses 11*a*, 11*a* that are open upward, are aligned with the two manifold openings 12*a*, 12*a*, respectively, and have substantially the same shape in their plan view as that of the manifold openings 12*a*. Each of the two manifold openings 12*a*, 12*a* cooperate with a corresponding one of the two manifold recesses 11*a*, 11*a* to define a manifold chamber.

The cavity sheet 14 has two arrays of elongate pressure chambers 16 that are formed through the thickness of the sheet 14, such that each of the pressure chambers 16 extends in a second direction (i.e., a widthwise direction) of the sheet 14 that is perpendicular to a first direction (i.e., a lengthwise direction) of the same 14. The two arrays of pressure chambers 16 are arranged in the first direction of the cavity sheet 14, basically on both sides of a centerline of the sheet 14 that is parallel to the first direction thereof, respectively, such that, however, respective inner end portions of the pressure chambers 16 of each array are located on the opposite side beyond the centerline. Therefore, the respective inner end portions of the pressure chambers 16 of one array are aligned with those of the pressure chambers 16 of the other array, in the first direction of the cavity sheet 14. Thus, the pressure chambers 16 are arranged in two arrays in a zigzag fashion. In the present embodiment, the ratio of the length of each pressure chamber 16 to the width thereof is about 8.

The respective inner end portions of the pressure chambers 16 communicate with the corresponding nozzles 54 of the nozzle sheet 43 via respective small-diameter through-holes 17 that are formed, similarly in a zigzag fashion, through the thickness of each of the spacer sheet 13 and the two manifold sheets 11, 12. On the other hand, respective outer end portions of the pressure chambers 16 of one array communicate with a corresponding one of the two manifold chambers of the manifold sheets 11, 12 via a corresponding one of two arrays of through-holes 18 that are formed through the thickness of the spacer sheet 13; and respective outer end portions of the pressure chambers 16 of the other array communicate with the other manifold chamber via the other array of through-holes 18 of the spacer sheet 13.

The cavity sheet 14 has, in one of lengthwise opposite end portions thereof, two supply holes 19*a* that are formed through the thickness of the sheet 14 and communicate with the two manifold openings 12*a* of the manifold sheet 12, respectively; and the spacer sheet 13 has, in one of lengthwise opposite end portions thereof, two supply holes 19*b* that are formed through the thickness of the sheet. 13 and communicate with the two manifold openings 12*a*, respectively. The supply holes 19*a* of the uppermost cavity sheet 14 are equipped with a filter 29 that removes dust from the ink supplied from an ink cartridge, not shown, located above the sheet 14.

The ink supplied from the ink cartridge to the two manifold chambers 11*a*, 12*a*; 11*a*, 12*a* via the supply holes 19*a*, 19*b* are distributed to the pressure chambers 16 via the respective through-holes 18, and then reach, via the through-holes 17, the nozzles 54 corresponding to the chambers 16.

Figure 3:
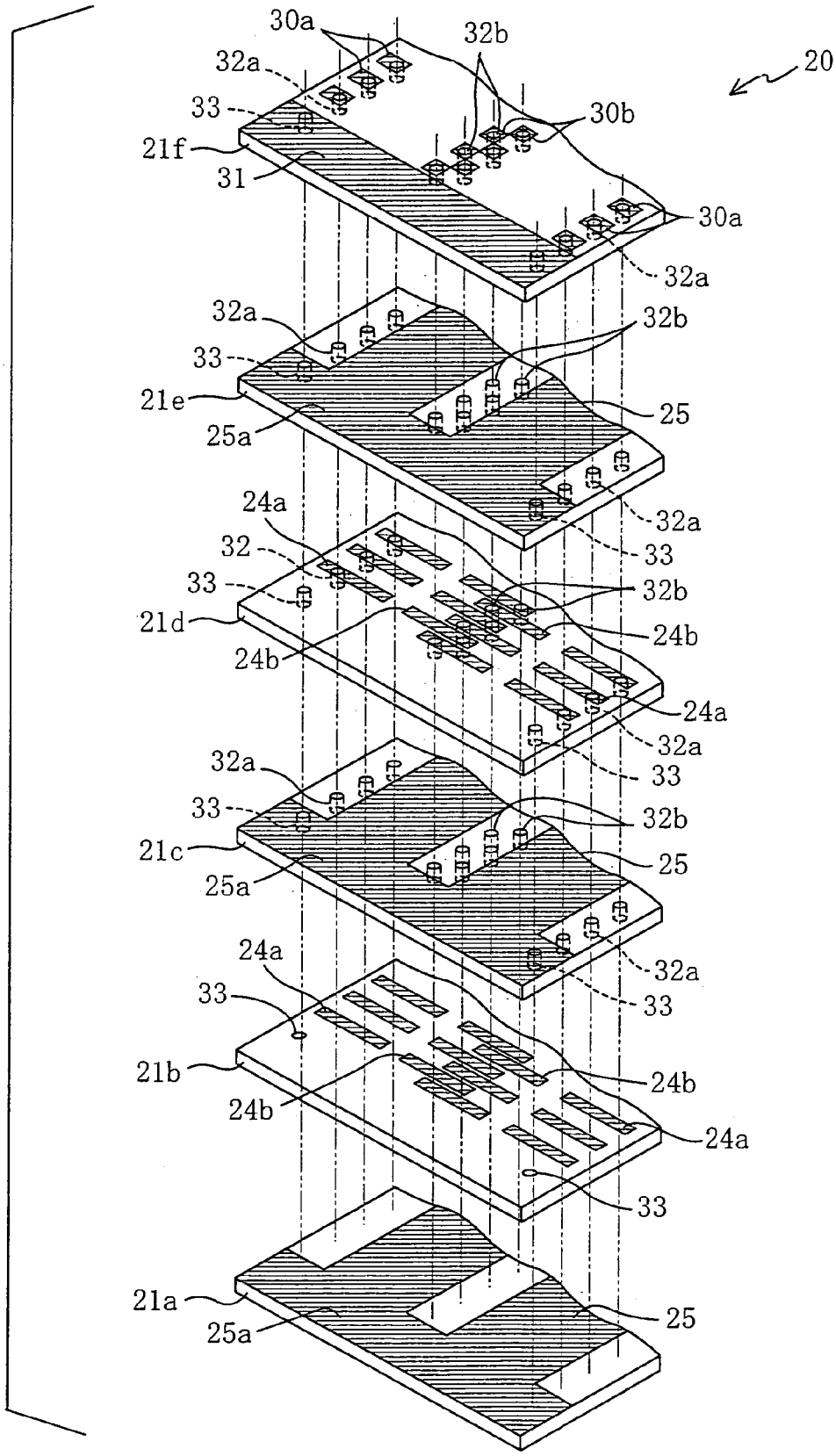
FIG. 3 is a perspective exploded view of an essential portion of an actuator unit as another part of the droplet ejecting apparatus.

As shown in FIG. 3, the actuator unit 20 has a construction in which six piezoelectric ceramic sheets 21*a*, 21*b*, 21*c*, 21*d*, 21*e*, 21*f* (hereinafter, simply referred to as the "piezoelectric sheets") are stacked on each other. Each of the piezoelectric sheets 21*a*-21*f* has a size that enables the each sheet 21*a*-21*f* to be opposed to all the pressure chambers 16, i.e., is common to all the chambers 16.

On an upper surface of each of the lowermost piezoelectric sheet 21*a* and every second piezoelectric sheet 21*c*, 21*e* as counted in an upward direction from the lowermost sheet 21*a*, a common electrode 25 is formed which is always kept at a constant electric potential (i.e., a ground potential). In addition, on an upper surface of each of the remaining piezoelectric sheets 21*b*, 21*d* except for the uppermost sheet 21*f*, a number of individual electrodes 24*a* and a number of individual electrodes 24*b* are formed whose electric potential can be controlled independent of each other. In the present embodiment, each of the piezoelectric sheets 21*a*-21*f* has a thickness of about 20 μm.

Each of the three common electrodes 25 includes two elongate portions that extend in a lengthwise direction of a corresponding one of the piezoelectric sheets 21*a*, 21*c*, 21*e*, such that the two elongate portions are opposed to the two arrays of pressure chambers 16, respectively, that are arranged in the lengthwise direction of the cavity sheet 14. Each of the two elongate portions of each common electrode 25 has a substantially rectangular shape in its plan view. Each common electrode 25 additionally includes, as integral portions thereof, two lead portions 25*a* corresponding to respective lengthwise opposite end portions of the corresponding one of the piezoelectric sheets 21*a*, 21*c*, 21*e*. Each of the two lead portions 25*a* extends over the entire width of the corresponding one of the sheets 21*a*, 21*c*, 21*e*.

On the other hand, each of the individual electrodes 24*a*, 24*b* has an elongate shape extending in the widthwise direction of the actuator unit 20. One individual electrode 24*a* located in a widthwise end portion of the actuator unit 20 and one individual electrode 24*b* located in a widthwise central portion of the same 20 and remote from the electrode 24*a* are paired, and are provided in an area corresponding to one pressure chamber 16 of the channel unit 10. All pairs of individual electrodes 24*a*, 24*b* corresponding to all pressure chambers 16 are arranged in two arrays in a zigzag fashion like the two arrays of pressure chambers 16 or the two arrays of nozzles 54. The widthwise central individual electrodes 24*b* of one array are partly aligned with the widthwise central individual electrodes 24*b* of the other array, as seen in the lengthwise direction of the actuator unit 20.

As shown in FIGS. 1 and 3, two arrays of surface electrodes 30*a* are formed on widthwise opposite end portions of an upper surface of the uppermost piezoelectric sheet 21*f*, and two arrays of surface electrodes 30*b* are formed on a widthwise central portion of the upper surface. The two arrays of surface electrodes 30*a* are located at respective positions right above the respective outer end portions of the two arrays of individual electrodes 24*a*; and the two arrays of surface electrodes 30*b* are located at respective positions right above the respective inner end portions of the two arrays of individual electrodes 24*b*. Each of the piezoelectric sheets 21*c*-21*f* except for the lowermost two sheets 21*a*, 21*b* has two arrays of through-holes 32*a* and two arrays of through-hole 32*b* that are formed through the thickness of the each sheet, at respective positions corresponding to the respective positions where the two arrays of surface electrodes 30*a* and the two arrays of surface electrodes 30*b* are located. The through-holes 32*a*, 32*b* are each filled with an electrically conductive material, so that the individual electrodes 24*a*, 24*b* of the piezoelectric sheets 21*b*, 21*d* stacked on each other are electrically connected to the surface electrodes 30*a*, 30*b*, respectively.

Additionally, two surface electrodes 31 are formed on lengthwise opposite end portions of the upper surface of the uppermost piezoelectric sheet 21*f*, such that the two surface electrodes 31 extend over the entire width of the uppermost sheet 21*f*. Thus, the two surface electrodes 31 are aligned, in their plan view, with the two lead portions 25*a* of each of the common electrodes 25 respectively formed on the piezoelectric sheets 21*a*, 21*c*, 21*e*. The uppermost piezoelectric sheet 21*f* has, in widthwise opposite end portions of each of the lengthwise opposite end portions thereof on which the surface electrodes 31 are formed, through-holes 33 formed through the thickness of the sheet 21*f*. Each of the underlying piezoelectric sheets 21*b* through 21*e* except for the lowermost sheet 21*a*, has through-holes 33 at respective positions corresponding to the positions where the through-holes 33 of the uppermost sheet 21*f* are formed. Like the through-holes 32*a*, 32*b*, the through-holes 33 are each filled with an electrically conductive material, so that the common electrodes 25 respectively formed on the piezoelectric sheets 21*a*, 21*c*, 21*e* stacked on each other are electrically connected to the surface electrodes 31.

Figure 5:
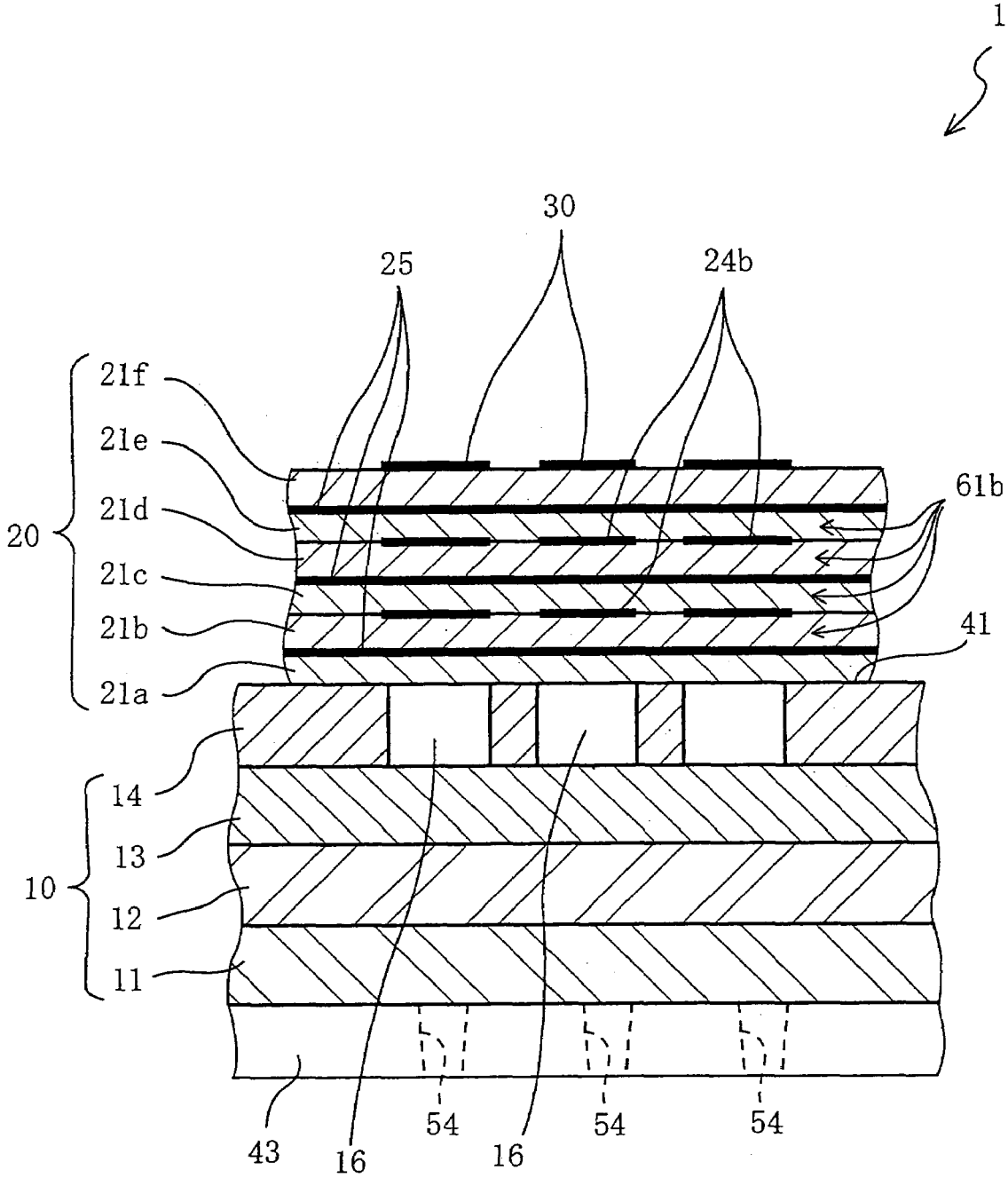
FIG. 5 is a cross-sectional view taken along 5-5 in FIG. 4.

As shown in FIG. 5, an adhesive sheet 41 is adhered to the entirety of a lower surface of the sheet-like actuator unit 20 that is opposed to the pressure chambers 16. The adhesive sheet 41 is provided in the form of an adhesive layer formed of a synthetic resin that does not allow penetration of ink. In addition, the actuator unit 20 is adhered to, and thereby fixed to, the channel unit 10, such that each pair of individual electrodes 24*a*, 24*b* is located at a position corresponding, in its plan view, to one of the pressure chambers 16.

In addition, as shown in FIG. 1, the flexible flat cable 40 is stacked on the upper surface of the actuator unit 20, so that various wire patterns are electrically connected to the surface electrodes 30*a*, 30*b*, 31.

An adhesive layer such as the adhesive sheet 41 may be formed of any material that does not allow penetration of ink and is electrically insulating. For example, the adhesive layer may be provided by a film formed of a polyamide-based hot-melt adhesive that contains, as a main component thereof, a nylon-based or dimer-acid-based polyamide resin; or a polyester-based hot-melt adhesive. Alternatively, the actuator unit 20 may be adhered to the channel unit 10, after a polyolefin-based hot-melt adhesive is applied to the actuator unit 20.

Figure 4:
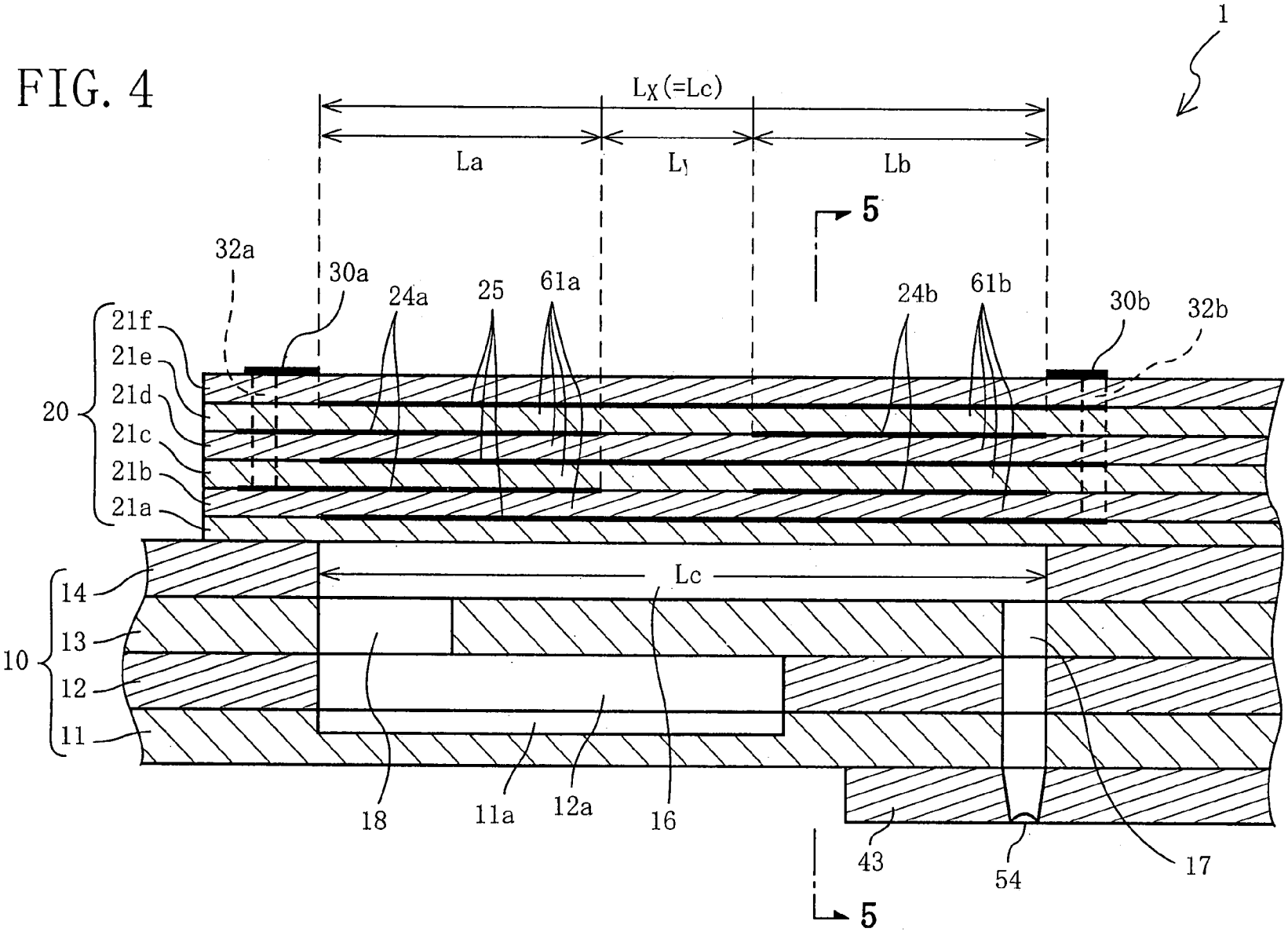
FIG. 4 is a cross-sectional view of an essential portion of the droplet ejecting apparatus, taken in a widthwise direction thereof.

FIG. 4 is a cross-sectional view of the ink jet printer head 1, taken in the widthwise direction thereof, i.e., taken in the lengthwise direction of one pressure chamber 16; FIG. 5 is a cross-sectional view taken along 5-5 in FIG. 4; and FIG. 6A is a plan view for explaining a positional relationship between one pressure chamber 16 of the channel unit 10 and two active portions. 61*a*, 61*b* (described in detail later) of the actuator unit 20 in the printer head 1.

As shown in FIG. 4, two individual electrodes 24*a*, 24*b* are paired and located in an area of each of the two piezoelectric sheets 21*b*, 21*d* that corresponds to each of the pressure chambers 16. Meanwhile, each of the three common electrodes 25 provided on the respective piezoelectric sheets 21*a*, 21*c*, 21*e* has the two elongate portions (see FIG. 3) each of which is opposed to the entire length of each of the pressure chambers 16 (see FIG. 4) and the entirety of a corresponding one of the two arrays of pressure chambers 16 (see FIG. 5). Respective portions of the four piezoelectric sheets 21*b*, 21*c*, 21*d*, 21*e* that are sandwiched by the three common electrodes 25 and all the individual electrodes 24*a*, 24*b* are polarized, in advance, by applying a high voltage thereto in a direction of thickness of the actuator unit 20, whereby pairs of active portions 61*a*, 61*b* are provided.

Thus, each pair of active portions 61*a*, 61*b* includes respective portions of the four piezoelectric sheets 21*b*-21*e* that are vertically aligned with two pairs of individual electrodes 24*a*, 24*b*. As shown in FIGS. 4 and 6A, the two active portions 61*a*, 61*b* has respective lengths, La, Lb, in the lengthwise direction of the pressure chamber 16. Respective outer ends of the two active portions 61*a*, 61*b* are substantially aligned with lengthwise opposite ends of the pressure chamber 16, respectively; and respective inner ends of the two active portions 61*a*, 61*b* are distant from each other by a distance, Ly. A distance, Lx, between the respective outer ends of the two active portions 61*a*, 61*b* is equal to a length, Lc, of the pressure chamber 16 (i.e., La+Ly+Lb=Lx=Lc).

Figure 6A:
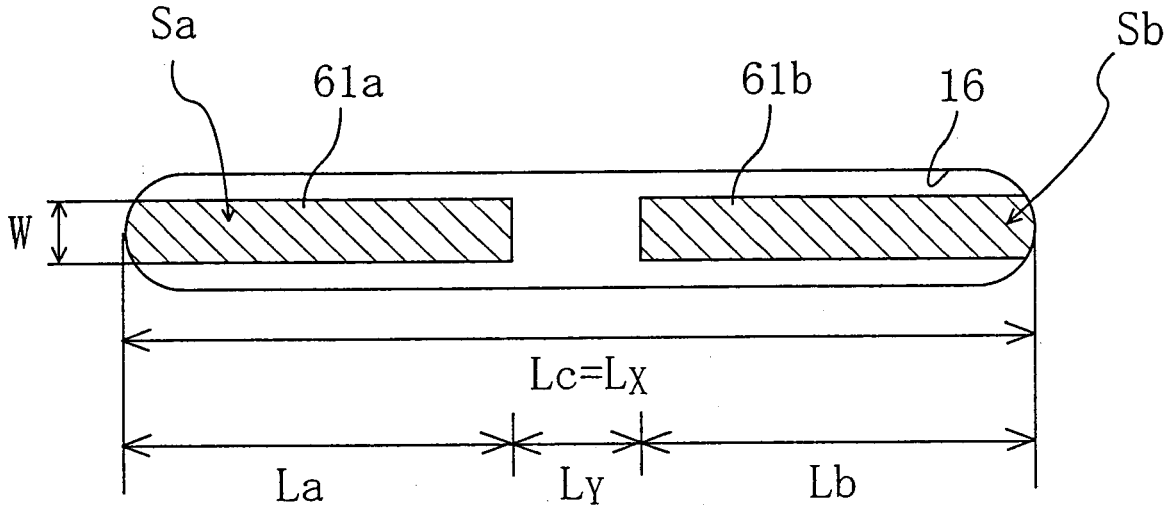
FIG. 6A is a plan view for explaining a relationship between respective positions of a pressure chamber and active portions in the droplet ejecting apparatus.

Meanwhile, as shown in FIG. 6A, a width, w, of each of the two active portions 61*a*, 61*b* is somewhat smaller than that of the pressure chamber 16. If the width w of each active portion 61*a*, 61*b* is substantially equal to that of the pressure chamber 16, then widthwise opposite ends of each of the individual electrodes 24*a*, 24*b* may overlap the cavity plate 14 and accordingly the deformation caused by each individual electrode 24*a*, 24*b* is adversely restrained and its efficiency is largely lowered. In addition, since the rate of increase of area of each individual electrode 24*a*, 24*b* is more largely increased by the increase of width thereof than the increase of length thereof, the increase of electric power consumption of each individual electrode 24*a*, 24*b* by the increase of electrostatic capacitance thereof cannot be neglected. That is, since, in the ink jet printer head 1, the width w of each active portion 61*a*, 61*b* is smaller than that of the pressure chamber 16, the deformation of each active portion 61*a*, 61*b* in the direction of thickness of each piezoelectric sheet 21*b*-21*e* is assured, and accordingly the amount of change of effective volume of the pressure chamber 16 can be increased efficiently with a considerably small amount of consumption of electric power.

In the present embodiment, the sum of respective areas, Sa, Sb, (in the plan view of FIG. 6A) of the two active portions 61*a*, 61*b* corresponding to each pressure chamber 16 is equal to the product of 0.8 and an area of a single active portion that has the width w and a length equal to the entire length Lc of the pressure chamber 16.

Next, there will be described a condition of the ink jet printer head 1 when the actuator unit 20 is being driven or operated, by reference to FIG. 7 corresponding to FIG. 4. In the present embodiment, in a normal or initial state of the printer head 1, no electric field is applied to the actuator unit 20 and accordingly the actuator unit 20 is not operated. When the printer head 1 ejects a droplet of ink, it is needed to operate the actuator unit 20.

The actuator unit 20 is operated by selectively applying an electric voltage to the two pairs of individual electrodes 24*a*, 24*b* corresponding to a desired pressure chamber 16. As a result, as shown in FIG. 7, the pair of active portions 61*a*, 61*b* are deformed in the direction of thickness of the actuator unit 20, and accordingly the volume of the pressure chamber 16 is decreased. Thus, a pressure wave is produced in the pressure chamber 16, and a droplet 50 of ink is ejected from the nozzle 54 corresponding to the pressure chamber 16.

More specifically described, a positive electric voltage is selectively applied to the two pairs of individual electrodes 24*a*, 24*b* via the wire pattern of the flexible flat cable 40 shown in FIG. 1, while the common electrodes 25 are connected to the ground. Thus, a drive electric field is produced in the pair of active portions 61*a*, 61*b* in the same direction as the direction of polarization thereof, so that each of the active portions 61*a*, 61*b* is elongated, owing to piezoelectric effect, in the direction of thickness of the actuator unit 20.

In addition, respective portions of the piezoelectric sheets 21*a*-21*f* that correspond to the distance Ly between the individual electrodes 24*a*, 24*b* are substantially entirely elongated in the same direction as the direction of elongation of the two active portions 61*a*, 61*b*. Though FIG. 7 shows that the center of those portions corresponding to the distance Ly is less deformed, this less deformation does not adversely influence the change of volume of the pressure chamber 16.

EXAMPLES

Figure 6B:
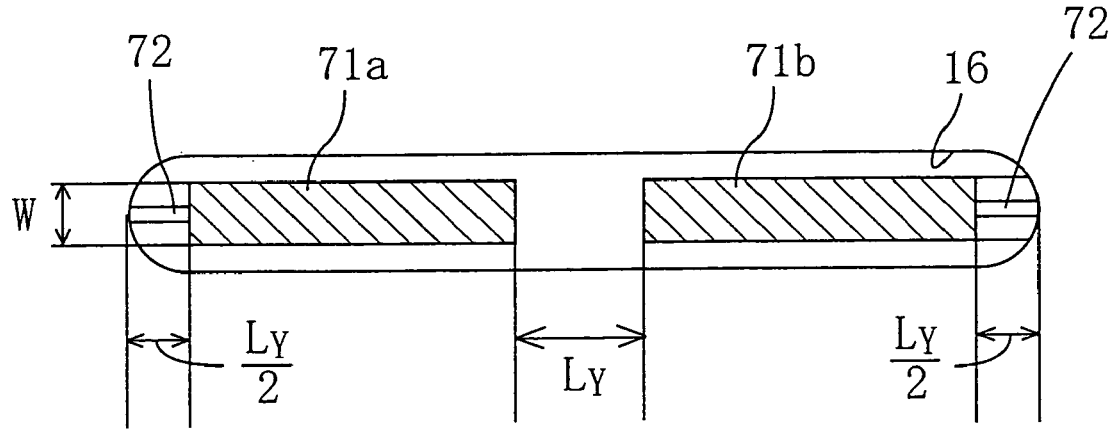
FIG. 6B is a plan view for explaining a relationship between respective positions of a pressure chamber and active portions in another droplet ejecting apparatus as another embodiment of the present invention.
Figure 8:
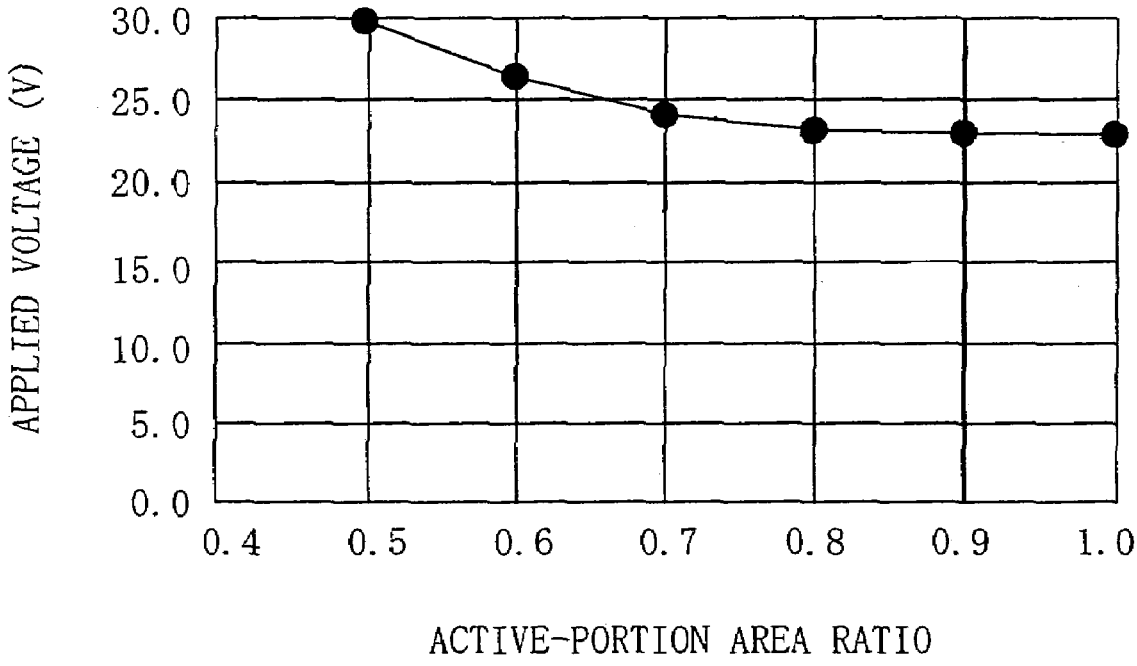
FIG. 8 is a graph showing a relationship between active portion area ratio and applied voltage.
Figure 9:
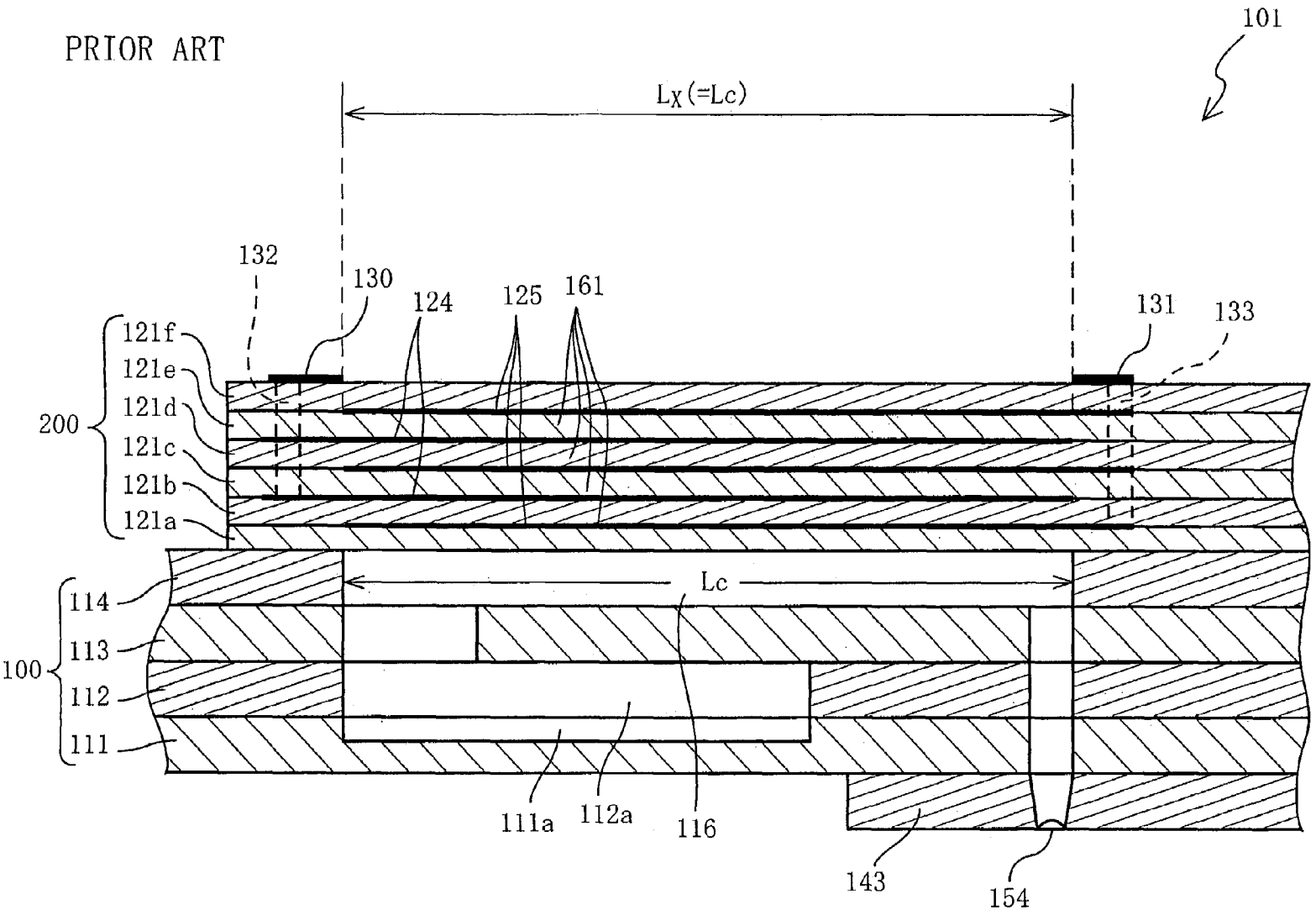
FIG. 9 PRIOR ART
FIG. 9 is a cross-sectional view corresponding to FIG. 4, and showing a conventional droplet ejecting device.
Figure 10:
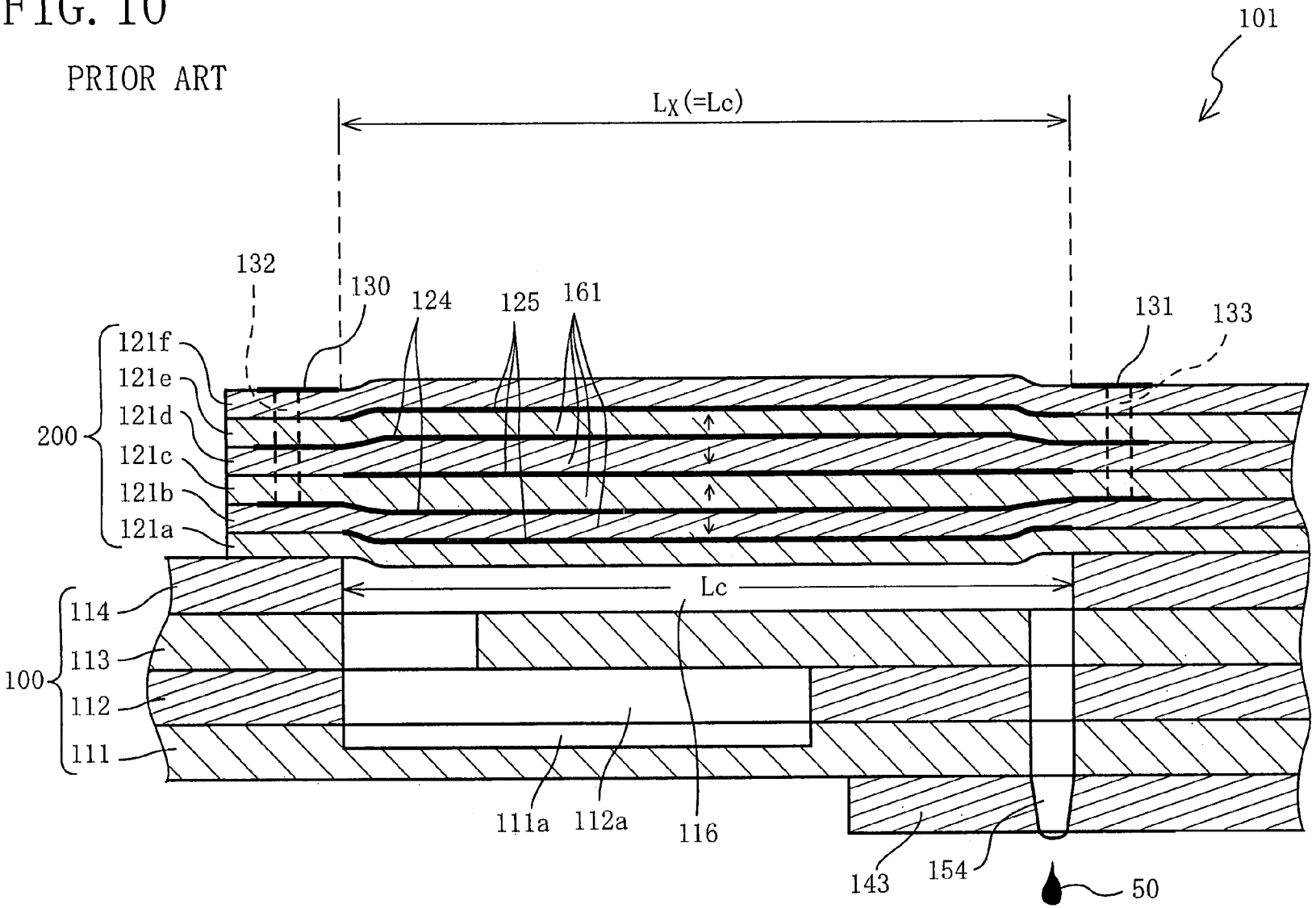
FIG. 10 PRIOR ART
FIG. 10 is a cross-sectional view corresponding to FIG. 7, and showing a condition of the conventional droplet ejecting device when an actuator unit thereof is being operated.

Various examples of the ink jet printer head 1 according to the present invention, and comparative examples were subjected to an experiment under the conditions that ambient temperature was 25° C. and the speed of ejection of liquid was 9 m/s. In the experiment, an area of a single active portion having the width w and a length equal to the entire length Lc of pressure chamber 16, shown in FIG. 6, was designated as S, and the ratio, (Sa+Sb)/S, of the sum, (Sa+Sb), of respective areas Sa, Sb of the two active portions 61*a*, 61*b* to the area S was changed in increments of 0.1 from 0.5 to 1.0 by changing the respective lengths La, Lb of the individual electrodes 24*a*, 24*b* and, for each example, an applied voltage and an electrostatic capacitance that were needed to obtain a predetermined change of volume of pressure chamber 16, were measured. The following TABLE shows, for each of the six examples, a relationship between active portion area ratio (Sa+Sb)/S and respective measured values of applied voltage V, electrostatic capacitance C, and product $C \times V^2$ of electrostatic capacitance C and square $V^2$ of applied voltage V. FIG. 8 shows a graph showing a relationship between active portion area ratio and applied voltage. In the experiment, the entire length Lc of pressure chamber 16 was 1.8 mm; and the width w of each active portion 61*a*, 61*b* was 140 μm.

TABLE

| ACTIVE PORTION AREA RATIO | APPLIED VOLTAGE(V) V | ELECTROSTATIC CAPACITANCE(nF) C | $C \times V^2$ |
|---|---|---|---|
| 0.5 | 30.0 | 0.5 | 450 |
| 0.6 | 26.5 | 0.6 | 421 |
| 0.7 | 24.0 | 0.7 | 403 |
| 0.8 | 23.0 | 0.8 | 423 |
| 0.9 | 22.9 | 0.9 | 472 |
| 1.0 | 22.8 | 1.0 | 520 |

As shown in TABLE, the active portion area ratio and the electrostatic capacitance are proportional to each other in the entire area-ratio range of from 0.5 to 1.0 and accordingly the capacitance is decreased as the sum (Sa+Sb) of respective areas of active portions 61*a*, 61*b* is decreased. Meanwhile, as shown in FIG. 8, the applied voltage needed to produce a predetermined change of volume of pressure chamber 16 changes in a narrow range of from 23.0 V to 24.0 V, i.e., does not largely change in an area-ratio range of not smaller than 0.7, but largely changes in an area-ratio range of smaller than 0.7. That is, if the sum (Sa+Sb) of respective areas of active portions 61*a*, 61*b* is excessively decreased to decrease the capacitance, an excessive increase of the applied voltage cannot be avoided.

In addition, since the amount of heat generated by a driver circuit 80 (FIG. 1) that drives the actuator unit 20, i.e., the electric power consumption of the same 20 is proportional to the product ($C \times V^2$) of electrostatic capacitance C and square $V^2$ of applied voltage V, the electric power consumption can be effectively reduced in the area-ratio range of from 0.6 to 0.8. From the above-indicated relationship between area ratio and applied voltage, it can be said that the ratio (Sa+Sb)/S of the sum (Sa+Sb) of respective areas of the two active portions 61*a*, 61*b* to the area S is preferably from about 0.7 to about 0.8, more preferably, about 0.8.

As is apparent from the foregoing description of the ink jet printer head 1, the two active portions 61*a*, 61*b* are provided in the area of the actuator unit 20 that corresponds to each of the pressure chambers 16 of the channel unit 10. In this case, the total electrostatic capacitance accumulated in the actuator unit 20 is smaller than the total electrostatic capacitance accumulated in an actuator unit in which each pair of active portions 61*a*, 61*b* is replaced with a single active portion having substantially the same size as the size of pressure chamber 16. Since the electrostatic capacitance of the actuator unit 20 is proportional to the electric power consumption of the driver circuit that drives the actuator unit 20, the electric power consumption of the driver circuit can be reduced and accordingly the driver circuit may have a considerably small size and cost low. In addition, since the amount of heat generated by the driver circuit can be reduced, a heat radiating device that radiates the heat generated by the driver circuit may have a small size or capacity The active portions 61*a*, 61*b* are polarized, in advance, in the respective directions of thickness of the piezoelectric sheets 21*b*-21*e* and, when an electric field is applied to the active portions 61*a*, 61*b*, i.e., the respective portions of the sheets 21*b*-21*e* that are sandwiched by the individual electrodes 24*a*, 24*b* and the common electrodes 25, in the same direction as the direction of polarization thereof, the active portions 61*a*, 61*b* are elongated in the respective directions of thickness of the sheets 21*b*-21*e*. The distance Ly between the two active portions 61*a*, 61*b* is pre-selected at the value that assures that when the two active portions 61*a*, 61*b* are elongated, the respective portions of the piezoelectric sheets 21*b*-21*f* that are located between the two active portions 61*a*, 61*b* are also elongated in the same direction as the direction of elongation of the portions 61*a*, 61*b*, as shown in FIG. 7. Thus, in the present embodiment, the volume of each pressure chamber 16 can be changed by substantially the same amount as the amount by which the volume of each pressure chamber 16 is changed in the case where a single active portion having substantially the same size as that of each pressure chamber 16 is provided.

Since the respective outer ends of the two active portions 61*a*, 61*b* are substantially aligned with the lengthwise opposite ends of the pressure chamber 16, the volume of the pressure chamber 16 as a whole can be changed. Therefore, pressure can be efficiently applied to the ink accommodated in the pressure chamber 16, and a droplet of ink can be smoothly ejected from the pressure chamber 16.

The sum of respective areas Sa, Sb of the two active portions 61*a*, 61*b* is equal to the product of 0.8 and the area of a single active portion having the width w and a length equal to the entire length Lc of pressure chamber 16. Therefore, the electric voltage applied to keep constant the speed of ejection of droplet from the nozzle 54, may be relatively low. In this case, since the driver circuit that drives the actuator unit 20 may have a relatively small size and cost low, the printer head 1 can joy an economical advantage. Moreover, the use of low electric voltage results in effectively reducing the amount of heat generated by the driver circuit.

While the present invention has been described in detail in its preferred embodiment, it is to be understood that the present invention is not limited to the details of the preferred embodiment and may be embodied with various changes and improvements.

For example, in the above-described embodiment, the droplet ejecting apparatus according to the present invention is applied to the ink jet printer head 1. However, the present invention may be applied to various sorts of apparatuses other than the printer head, so long as those apparatuses utilize piezoelectric effect to eject liquid supplied from a liquid supply source, through a nozzle.

It is preferred that a resisting layer that resists the deformation of the active portions 61*a*, 61*b* in a direction opposite to the pressure chamber 16 be provided on the upper surface of the actuator unit 20, as taught by the previously-identified Japanese Patent No. 3,128,857. In this case, almost all portions of deformation of the active portions 61*a*, 61*b* are advantageously directed to change the pressure in the pressure chamber 16.

Figure 7:
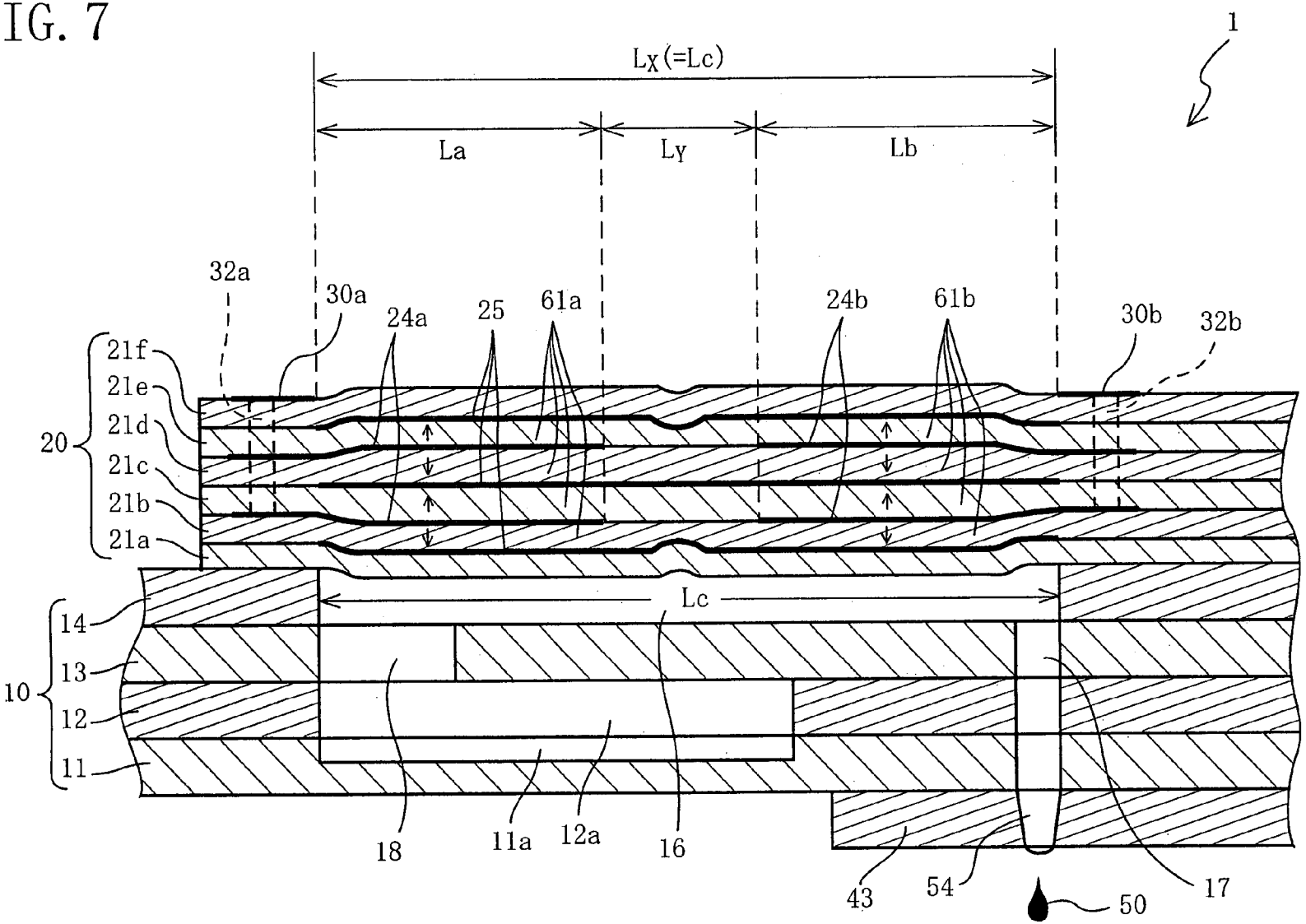
FIG. 7 is a cross-sectional view corresponding to FIG. 4, and showing a condition of the droplet ejecting apparatus of FIG. 1 when the actuator unit thereof is being operated.

It is not essentially required that the respective outer ends of the active portions 61*a*, 61*b* be substantially aligned with the corresponding lengthwise opposite ends of the pressure chamber 16, as shown in FIG. 4 or FIG. 7. That is, the respective outer ends of the active portions 61*a*, 61*b* may be located inside, or outside, the corresponding lengthwise opposite ends of the pressure chamber 16. For example, in a modified embodiment shown in FIG. 6B, respective outer ends of two active portions 71*a*, 71*b* are located inside corresponding lengthwise opposite ends of a pressure chamber 16, such that a distance between the outer end of each active portion 71*a*, 71*b* and the corresponding one of the lengthwise opposite ends of the pressure chamber 16 is equal to, or not more than, Ly/2, i.e., half a distance Ly between the two active portions 71*a*, 71*b*. The two active portions 71*a*, 71*b* include two pairs of individual electrodes 24*a*, 24*b* that are connected via respective lead portions 72 to two surface electrodes 30*a*, 30*b*.

It is not essentially required that the distance Ly between the two active portions 61*a*, 61*b* corresponding to each pressure chamber 16 be pre-selected at the value that assures that when the two active portions 61*a*, 61*b* are elongated, the respective portions of the piezoelectric sheets 21*a*-21*f* that are located between the two active portions 61*a*, 61*b* are substantially wholly elongated in the same direction as the direction of elongation of the active portions 61*a*, 61*b*, so long as those portions located between the two active portions 61*a*, 61*b* are sufficiently largely elongated so as to smoothly eject droplets of liquid. Preferably, those portions located between the two active portions 61*a*, 61*b* are elongated by not less than 90% of an amount of elongation of each of the active portions 61*a*, 61*b*.

In the illustrated embodiment, the individual electrodes 24*a*, 24*b* are paired, and are located in the area of the actuator unit 20 that corresponds to each pressure chamber 16 of the channel unit 10, and the two active portions 61*a*, 61*b* corresponding to the two individual electrodes 24*a*, 24*b* are provided in the same area. However, it is possible to provide three or more individual electrodes 24 in the area of the actuator unit 20 that corresponds to each pressure chamber 16 of the channel unit 10, and provide three or more active portions 26 corresponding to the three or more individual electrodes 24 in the same area.

In the illustrated embodiment, the ink jet printer head 1 ejects a droplet of ink in a "fire-before-fill" method in which, in a normal or initial state of the head 1, no electric voltage is applied to the individual electrodes 24*a*, 24*b* and, when a droplet of ink is ejected, an electric voltage is selectively applied to the individual electrodes 24*a*, 24*b* so as to decrease the volume of the pressure chamber 16 and thereby eject the ink droplet. However, the present invention is not limited to the "fire-before-fill" method. For example, the present invention is applicable to a "fill-before-fire" method, described below. In the "fill-before-fire" method, in a normal or initial state of the printer head 1, all the pairs of individual electrodes 24*a*, 24*b* are kept at a positive potential, whereby respective electric fields are applied to all the pairs of active portions 61*a*, 61*b*, so as to decrease the respective volumes of all the pressure chambers 16 and, when a droplet of ink is ejected, one or more electric fields being applied to desired one or more pairs of active portions 61*a*, 61*b* are removed so that one or more pairs of active portions 61*a*, 61*b* return to its or their initial positions, so as to increase the volume or volumes of one or more pressure chambers 16. As a result, a pressure wave is produced in the pressure chamber or chambers 16, and subsequently is propagated in the lengthwise direction of the pressure chamber 16 or each pressure chamber 16. When the electric field is applied again at a timing when the pressure wave turns positive, the volume of the pressure chamber 16 is decreased and a pressure is applied to the ink accommodated in the chamber 16, so that a droplet 50 of ink is ejected from the chamber 16. Since, in the fill-before-fire method, two pressures can be superposed on each other, a considerably small energy can be used to apply a high pressure to the ink.

In the illustrated embodiment, the actuator unit 20 is provided by the plurality of piezoelectric sheets on each of which the pairs of individual electrodes 24*a*, 24*b*, or the single common electrode 25 is printed and which are stacked on each other. However, the actuator unit 20 may be provided by a different element, so long as it has active portions that can deform to change the volume of each pressure chamber 16.

In the illustrated embodiment, the active portions 61*a*, 61*b* are provided by not all the piezoelectric sheets 21*a* through 21*f* of the actuator unit 20 but only the intermediate sheets 21*b* through 21*e*. However, the active portions 61*a*, 61*b* may be provided by all the piezoelectric sheets 21 of the actuator unit 20. When the piezoelectric sheets 21 are stacked on each other, the common electrodes 25 and the individual electrodes 24*a*, 24*b* may be arranged on the respective sheets 21, in various manners.

In the illustrated embodiment, the width w of the active portions 61*a*, 61*b* is somewhat smaller than that of each pressure chamber 16. However, the width w of the active portions 61*a*, 61*b* may be larger than that of each pressure chamber 16. In addition, the shape of each pressure chamber 16 or the active portions 61*a*, 61*b*, the number of the piezoelectric sheets 21 stacked on each other, and/or the direction in which the pressure chambers 16 are arranged may be modified, as needed.

In the illustrated embodiment, the three common electrodes 25 arranged as the three layers stacked in the direction of thickness of the actuator unit 20 are electrically connected to each other by utilizing the through-holes 33. However, this electrical connection may be made in various different manners. For example, it is possible to employ such a manner in which the respective lead portions 25*a* of all the common electrodes 25 are exposed in one side surface of the actuator unit 20, a connection electrode that is connected to all the lead portions 25*a* is applied to the one side surface of the unit 20 such that the connection electrode extends in the direction of thickness of the unit 20, and the connection electrode is electrically connected to the surface electrode 31 provided on the uppermost piezoelectric sheet 21*f*.

In the illustrated embodiment, the individual electrodes 24*a*, 24*b* arranged as the two layers stacked in the direction of thickness of the actuator unit 20 are electrically connected to each other by utilizing the through-holes 32. However, this electrical connection may be made in various different manners. For example, it is possible to employ such a manner in which respective outer end portions of the outer ones 24*a* of the pairs of outer and inner individual electrodes 24*a*, 24*b* are exposed in another or second side surface of the actuator unit 20, connection electrodes each of which is connected to the outer end portions of a corresponding group of outer individual electrodes 24*a* vertically aligned with each other, is applied to the second side surface of the unit 20, such that the connection electrodes extend in the direction of thickness of the unit 20, and the connection electrodes are electrically connected to the corresponding surface electrodes 30*a* provided on the uppermost piezoelectric sheet 21*f*.

It is to be understood that the present invention may be embodied with various changes and improvements that may occur to a person skilled in the art, without departing from the spirit and scope of the invention defined in the appended claims.

What is claimed is:

1. A droplet ejecting apparatus comprising:

a channel unit having a plurality of pressure chambers which communicate, at respective first ends thereof, with a liquid supply manifold so as to be supplied with a liquid by the liquid supply manifold and, at respective second ends thereof, with respective nozzles so as to eject respective droplets of the liquid through the respective nozzles; and an actuator unit fixed to the channel unit;

wherein the actuator unit has a plurality of groups of active portions each group of which includes two active portions which are opposed in a first direction to a corresponding one of the plurality of pressure chambers, at respective different positions in a second direction perpendicular to the first direction;

wherein each of the two active portions of said each group includes a piezoelectric sheet, and a first electrode and a second electrode which are opposed to each other in a direction of thickness of the piezoelectric sheet that is parallel to the first direction, such that the first and second electrodes cooperate with each other to sandwich the piezoelectric sheet;

wherein when an electric voltage is applied across the first and second electrodes of said each of the two active portions of said each group, the two active portions are deformed to change a volume of said corresponding pressure chamber;

wherein the respective piezoelectric sheets of the two active portions of said each group comprise respective portions of a common piezoelectric sheet which additionally includes an intermediate portion continuous with said respective portions in a direction in which the two active portions are distant from each other, and the respective portions of the common piezoelectric sheet are polarized in a direction of thickness of the common piezoelectric sheet, and wherein when an electric field is applied to the respective portions of the common piezoelectric sheet in a same direction as the direction of polarization thereof, the two active portions are elongated in the direction of thickness of the common piezoelectric sheet; and wherein a distance between the two active portions of said each group is selected at a value which assures that, when the two active portions are elongated in the direction of thickness of the common piezoelectric sheet, the intermediate portion of the common piezoelectric sheet that is located between the two active portions is elongated in a same direction as the direction of elongation of the two active portions.

2. The apparatus according to claim 1, wherein said intermediate portion of the common piezoelectric sheet that is located between the two active portions of said each group is elongated in the same direction as the direction of elongation of the two active portions, by not less than 90% of an amount of elongation of each of the two active portions.

3. The apparatus according to claim 1, wherein the liquid supply manifold comprises an ink supply manifold which supplies an ink as the liquid, and wherein the actuator unit changes a volume of each of the pressure chambers of the channel unit, so as to eject, from a corresponding one of the nozzles, a droplet of the ink as the droplet of the liquid and thereby form an image on a recording medium.

4. The apparatus according to claim 1, wherein the common piezoelectric sheet is commonly opposed in the first direction to respective entire areas of the plurality of pressure chambers.

5. A droplet ejecting apparatus comprising:

a channel unit having a plurality of elongate pressure chambers which communicate, at respective first ends thereof, with a liquid supply manifold so as to be supplied with a liquid by the liquid supply manifold and, at respective second ends thereof, with respective nozzles so as to eject respective droplets of the liquid through the respective nozzles; and an actuator unit fixed to the channel unit;

wherein the actuator unit has a plurality of groups of active portions each group of which includes two active portions which are opposed in a first direction to a corresponding one of the plurality of elongated pressure chambers, at respective different positions in a second direction perpendicular to the first direction;

wherein each of the two active portions of said each group includes a piezoelectric sheet, and a first electrode and a second electrode which are opposed to each other in a direction of thickness of the piezoelectric sheet that is parallel to the first direction, such that the first and second electrodes cooperate with each other to sandwich the piezoelectric sheet;

wherein when an electric voltage is applied across the first and second electrodes of said each of the two active portions of said each group, the at least two active portions are deformed to change a volume of said corresponding elongate pressure chamber;

wherein an outer end portion of at least one of the two active portions of said each group that are opposed to the corresponding elongate pressure chamber is located at a position corresponding to a vicinity of an end portion of the corresponding elongate pressure chamber; and wherein the two active portions of said each group are distant from each other by a predetermined distance in a lengthwise direction of the corresponding elongate pressure chamber, and wherein an outer end portion of at least one of the two active portions is located at a position inwardly distant from at least one of lengthwise opposite ends of the corresponding elongate pressure chamber by not more than 50% of said predetermined distance.

6. A droplet ejecting apparatus comprising:

a channel unit having a plurality of pressure chambers which communicate, at respective first ends thereof, with a liquid supply manifold so as to be supplied with a liquid by the liquid supply manifold and, at respective second ends thereof, with respective nozzles so as to eject respective droplets of the liquid through the respective nozzles; and an actuator unit fixed to the channel unit;

wherein the actuator unit has a plurality of groups of active portions each group of which includes at least two active portions which are opposed in a first direction to a corresponding one of the plurality of elongated pressure chambers, at respective different positions in a second direction perpendicular to the first direction;

wherein each of the at least two active portions of said each group includes a piezoelectric sheet, and a first electrode and a second electrode which are opposed to each other in a direction of thickness of the piezoelectric sheet that is parallel to the first direction, such that the first and second electrodes cooperate with each other to sandwich the piezoelectric sheet;

wherein when an electric voltage is applied across the first and second electrodes of said each of the at least two active portions of said each group, the at least two active portions are deformed to change a volume of said corresponding pressure chamber; and wherein a ratio of a sum of respective areas of the at least two active portions of said each group to an area equal to a product of a length of the corresponding pressure chamber and a width of said each of the at least two active portions as measured in a direction perpendicular to a lengthwise direction of the corresponding pressure chamber is not smaller than 0.7 and smaller than 1.

7. The apparatus according to claim 6, wherein said ratio is smaller than 0.8.

8. A droplet ejecting apparatus, comprising:

a channel unit having a plurality of elongate pressure chambers which communicate, at respective first ends thereof, with a liquid supply manifold so as to be supplied with a liquid by the liquid supply manifold and, at respective second ends thereof, with respective nozzles so as to eject respective droplets of the liquid through the respective nozzles; and an actuator unit fixed to the channel unit, wherein the actuator unit has a plurality of groups of elongate active portions each group of which includes at least two elongate active portions which are opposed in a first direction to a corresponding one of the plurality of elongate pressure chambers, at respective different positions in a second direction perpendicular to the first direction, wherein each of said at least two elongate active portions of said each group includes a piezoelectric sheet, and a first electrode and a second electrode which are opposed to each other in a direction of thickness of the piezoelectric sheet that is parallel to the first direction, such that the first and second electrodes cooperate with each other to sandwich the piezoelectric sheet, wherein when an electric voltage is applied across the first and second electrodes of said each of the at least two elongate active portions of said each group, the at least two elongate active portions are deformed to change a volume of said corresponding elongate pressure chamber, and wherein a first ratio of a sum of respective lengths of the at least two elongate active portions of said each group to a length of the corresponding elongate pressure chamber is not smaller than 0.7 and smaller than 1.

9. The apparatus according to claim 8, wherein said first ratio is smaller than 0.8.

10. The apparatus according to claim 8, wherein the at least two elongate active portions of said each group comprise two elongate active portions which are distant from each other in a lengthwise direction of the corresponding elongate pressure chamber and each of which extends parallel to the corresponding elongate pressure chamber, and wherein the corresponding elongate pressure chamber has a first width, and each of the at least two elongate active portions has a second width smaller than the first width.

11. The apparatus according to claim 10, wherein a second ratio of a sum of respective areas of the at least two elongate active portions to an area equal to a product of the second width of said each elongate active portion and a length of the corresponding elongate pressure chamber is not smaller than 0.7 and smaller than 1.

12. The apparatus according to claim 11, wherein said second ratio is smaller than 0.8.

13. A droplet ejecting apparatus comprising:

a channel unit having a plurality of pressure chambers which communicate, at respective first ends thereof, with a liquid supply manifold so as to be supplied with a liquid by the liquid supply manifold and, at respective second ends thereof, with respective nozzles so as to eject respective droplets of the liquid through the respective nozzles; and an actuator unit fixed to the channel unit;

wherein the actuator unit has a plurality of groups of active portions each group of which includes at least two active portions which are opposed in a first direction to a corresponding one of the plurality of pressure chambers, at respective different positions in a second direction perpendicular to the first direction;

wherein each of said at least two active portions of said each group includes a piezoelectric sheet, and a first electrode and a second electrode which are opposed to each other in a direction of thickness of the piezoelectric sheet that is parallel to the first direction, such that the first and second electrodes cooperate with each other to sandwich the piezoelectric sheet;

wherein when an electric voltage is applied across the first and second electrodes of said each of the at least two active portions of said each group, the at least two active portions are deformed to change a volume of said corresponding pressure chamber; and wherein the apparatus further comprises a driver circuit which drives the actuator unit in a single driving mode in which the driver circuit thoroughly simultaneously applies respective equal electric voltages to said at least two active portions of an arbitrary one of the plurality of groups so as to thoroughly simultaneously deform said at least two active portions and thereby change the volume of said corresponding pressure chamber, and which does not drive the actuator unit in any modes different from said single driving mode.

* * * * *